US006073362A

United States Patent [19]

Dean et al.

[11] Patent Number: 6,073,362

[45] Date of Patent: Jun. 13, 2000

[54] ADAPTER AND METHOD FOR CLEANING PAINT ROLLERS

[76] Inventors: Dan Dean, 106 Silver Shoals, Shell Beach, Calif. 93449; Charles R. DeCola, 1060 Zinnia Ct., Nipomo, Calif. 93444

[21] Appl. No.: 09/129,393

[22] Filed: Aug. 5, 1998

[51] Int. Cl.[7] ..... F26B 17/24

[52] U.S. Cl. ..... 34/58

[58] Field of Search ..... 34/58, 59, 60, 34/61, 72, 90, 312, 323, 324, 326; 366/279, 306, 343; 134/138, 196, 900; 15/38, 105, 236.03

[56] References Cited

U.S. PATENT DOCUMENTS

| | | | |
|---|---|---|---|
| 2,884,709 | 5/1959 | Kruger | 34/58 |
| 2,912,769 | 11/1959 | Kruger | 34/58 |
| 2,931,661 | 4/1960 | Harris | 34/58 X |
| 3,733,645 | 5/1973 | Seiler | 34/58 X |
| 4,108,189 | 8/1978 | Clairborne et al. | 134/138 |
| 4,377,175 | 3/1983 | Fritz | 134/138 |
| 4,448,209 | 5/1984 | Lindsay | 134/141 |
| 4,733,679 | 3/1988 | Dolcater | 134/138 |
| 5,185,938 | 2/1993 | Hutt | 34/58 |
| 5,473,823 | 12/1995 | Powell | 34/58 |
| 5,505,220 | 4/1996 | Goreckie | 134/138 |
| 5,539,948 | 7/1996 | McCauley et al. | 15/105 |
| 5,588,221 | 12/1996 | Hoeltke et al. | 34/58 |
| 5,621,979 | 4/1997 | Taylor | 34/58 |
| 5,630,284 | 5/1997 | Huang | 34/58 |
| 5,784,798 | 7/1998 | Taylor | 34/58 |
| 5,873,176 | 2/1999 | Richards | 34/58 |
| 5,937,534 | 8/1999 | Anderson et al. | 34/58 |

*Primary Examiner*—Stephen Gravini

[57] ABSTRACT

A paint roller adapter is disclosed which includes a substantially longitudinal first rod and a second rod. The first rod is suitable for being received by a drill chuck. The second rod, being longer in length than the first rod, is capable of receiving a mini-roller about the longitudinal centroid of the roller. Between the first and second rods may include a handle portion to facilitate a user grasping the adapter. Between the handle and the second rod is a step taper, preferably with annular ribs thereon. This step taper has a gradual increase in diameter from the surface of the second rod increasing in the direction of the handle. This gradual taper provides secure frictional contact between the roller and the taper/second rod combination, thus securably fastening the roller to the adapter. Between the handle and the first rod exists an annular taper that would facilitate the insertion of the first rod into a paint roller spinner, the jaws of the roller securing onto the handle. This allows for a method of cleaning the roller by rotating the adapter and roller secured thereon, through the centroid of the roller, thus allowing for a high angular velocity, the centrifugal force displacing the moisture, paint and debris therefrom.

17 Claims, 4 Drawing Sheets

ADAPTER AND METHOD FOR CLEANING PAINT ROLLERS

BACKGROUND OF THE INVENTION

1. Field of the Invention

The invention herein relates to a tool to assist in the removal of paint from a paint roller and more particularly to a tool that enables the weenie roller to be placed in a spinner or electric drill to spin and remove the paint therefrom.

2. Overview of Prior Art

Every home owner who has awakened with the ambition to change the color of a room or even the entire house has embraced the efficiency of the paint roller. Paint rollers are made of absorbent material that drinks up paint so that a single "refueling" of paint enables a large area to be covered. This increases the efficiency of the device. The problem with this absorbency is that the paint left in the roller is many times difficult to remove from the roller when that job is finished. For the occasional painter the rollers are usually discarded, which is wasteful but for the professional painter this is a costly consequence that is not acceptable. As such, many devices are used to spin the rollers, using centrifugal force to throw the paint off of the roller, thereby enabling them to be used again. A device called a "spinner" is commonly used to hold brushes and large rollers to spin then clean and dry.

Mini rollers or "weenie rollers" which are, generally speaking, smaller versions of more traditional rollers and are used for painting hard to reach places and sharp comers. Weenie rollers have a one to one and one half inch diameter. This decrease in radius from the central axis of rotation in a spinner greatly decreases the centrifugal force applied to any particle of paint thereon. As such, speed of rotation is of critical importance. Many electric drills are not capable of reaching speeds that are adequate and the spinner is the only appropriate tool. Unfortunately the spinner includes a set of jaws that are designed to receive the handle of a brush but not a weenie roller.

Few attempts have been made to create an adapter that would enable a weenie roller to be received by a spinner and all fall short in terms of functionality. One such attempt was made be Powell in U.S. Pat. No. 5,473,823. Here Powell discloses a handle with a tapered rod extending therefrom. The taper is on the end of the rod, apparently to facilitate insertion into the interior cavity of the roller. The problem with this is that different manufacturers of rollers have products that are slightly different in length, taper of the internal cavity and design, making it difficult to securely support a shaft adequately for spinning the roller.

Powell disclosed a mini-roller that is cylindrical with a cylindrical passage there-through. This is not as common as a cylinder with one side open and the passage in the form of a taper, or with a washer positioned slightly past the center of the roller to support the end of the shaft. Powell could not adequately support either of these common roller designs because the taper on the shaft would preclude support on the end of the roller. Furthermore, the absence of a taper on the medial end of the shaft precludes the roller from being secured to the tool. Both of which are vitally important to the function of the device.

Another cleaner adapter was disclosed by McCauley et al in U.S. Pat. No. 5,539,948 in which an elongated rectangular section is shown with a rod portion extending from at least one end. In one embodiment the device has a tapered portion which is intended to receive the inside of a large paint roller.

A notch is removed from one blade of this version of the device. The notch is used to scrape the roller to assist in the removal of paint and water. Sharp edges such as would be present here will damage the nap of the roller, greatly reducing its life. The taper is intended to allow variability in the size of the roller. Unfortunately, since the device is on a taper with no visible means of support on the end of the adapter, the roller would be supported by exactly four points on one extreme end of the roller. This makes the roller extremely unstable and when rotated at high speed, the free end of the roller would have a tendency to wobble and could fall off the device. If the size of the roller was such that it was supported in the same location as the notch, then the roller would be supported by only three points, exaggerating the aforementioned problem. Also, rotating fins present a danger of injury as compared to a smooth design.

Additionally the device includes a first side (54) which is the small side of the device to be grasped by the spinner or drill chuck. This would necessitate the device be inordinately long or that only paint rollers of minimal length could be used to fit the roller onto the fins of the device while allowing sufficient room for the spinner to adequately grab the device by the same direction of assembly. A rod portion (58) extends from the other end, the combination being potentially very unstable. Also because of the orientation of the device in the spinner the process of changing the rollers requires removal of the device from the spinner each time. Further adding to the inefficiency of use of the device.

The device of McCauley et al includes a rod portion (58) which is intended to support a small roller. The rod is assumed to be without a taper until the element (55), which is shown to be an arcuate taper on the medial end of the rod. This is intended to support the internal diameter of the small roller to temporarily secure it so that it can be spun in the spinner. Again this is only supporting the roller in a minimal way, here in only two places. The patent claims a tapered element . . . intermediate said second side and said rod element. Therefore it must be continuous with the elongated wing that makes up the second side of the elongated portion. The applicant has tried such a device and has found them to be inadequate in releasably securing the small roller to a device including a rod to support the roller. The lack of friction by supporting it in only two places causes the roller to prematurely disengage from the device. If the roller falls off the device the roller is now not only wet and "painty" it is also potentially dirty.

Another device that is intended to be adapted into an electric drill is disclosed by Hutt in U.S. Pat. No. 5,185,938. Here a device is disclosed which has the capability of holding a brush or a large roller and the device can be secured into the chuck of an electric drill. The device is a complex system of articulating parts that include a jaw head that retracts to accept a large roller and articulates to expand within the inside of the roller to secure same. The device is relatively expensive to manufacture and therefore limited in its usefulness. The device is not deemed appropriate to be received by a spinner. The mini-rollers require greater speed of rotation that are evident with the spinner but not with most electric drills. As such, this device is not intended nor applicable to use with the small rollers.

A similar product is disclosed by Seiler in U.S. Pat. No. 3,733,645 insofar as the adaptation to large paint rollers being spun by an electric drill. Here the device is greatly simplified as compared to that of Hutt and is comprised of a longitudinal rod with one end fixed to a plurality of fins. The combination is two fold in that upon rotary actuation it can be used to mix paint or inserted into a large roller and used to spin the paint and moisture from the roller. The cylindrical rod that is used in the drill chuck is not adapted to be used in a spinner and the lack of adaptableness to the inside diameter of the roller makes it inappropriate to be used in that manner.

A series of paint roller cleaners are disclosed in the art which include some sort of water jet assembly to assist in the cleansing of the paint roller. These include U.S. Pat. No. 3,818,529 to Leggett and U.S. Pat. No. 4,108,189 to Claiborne et al. In both disclosures a supportive frame is used which allows the roller to rotate as one or more water jet(s) are used to assist in the removal of paint therefrom.

Closed containers are used in disclosures by Lindsay, Dolcater, Fritz and Gorecki in U.S. Pat. Nos. 4,448,209; 4,733,679; 4,377,175 and 5,505,220 respectively. Here canisters are used to contain the resulting fluid as water or another solvent can be projected onto the roller. The placement of the jets in most cases, such as is apparent with Dolcater, Fritz and Gorechi, to cause the roller to rotate as they are washed where Lindsay includes a mechanism to drive the rollers to rotate as they are washed. Fritz and Lindsay disclose systems that can be closed where Dolcater and Gorecki disclose devices with a open end to facilitate replacement of the rollers to be cleansed. All of these disclosures are complex and therefore relatively expensive to manufacture relative to a simple and tool that can be used with a spinner. Also these are all disclosed to be used with the rotary mount of a paint roller support, including or similar to that of a large paint roller. As such, it is not anticipated that these would be used for a mini-roller or weenie roller.

SUMMARY OF THE INVENTION

The disclosed invention relates to a device that is adapted to be received by a high speed electric drill and a spinner similar to that shown in U.S. Pat. No. 2,912,769. In the preferred embodiment the device includes an elongated, cylindrical handle with a first end and a second end. The first end has a substantially cylindrical first rod extending therefrom. This first rod is suited for being received by the chuck of an electric drill and can also be inserted into the cavity of the jaws of a spinner. Intermediate to the first end of the handle and the first rod is a first taper. This first taper offers a ramped transition between the adjacent parts, the handle is of greater diameter than the first rod. Insertion into the spinner is therefore aided by the first taper in pressing the first rod into the jaws of a spinner, the ramp opening them up further to receive the handle, thereby securing it in the spinner.

Extending from the second end of the handle is a second longitudinal rod called a roller insert rod. The distal end of the roller insert rod may include a chamfered or radiused portion thereon to facilitate insertion into the cavity of a mini-roller. At the intermediate portion of the roller insert rod and the second end of the handle is a step taper. This taper is of a gradual increase in diameter as it nears a step to up to the diameter of the handle. This step taper can include a plurality of annular rings to further facilitate the releasably joined union of the mini-roller and the step taper thereby securing the roller in a complete ring about one end of the roller and the insert rod supporting the body of the roller, thereby allowing the roller to be securely and safely supported so that it is capable of rotating smoothly even at the high speeds caused by a spinner.

DETAILED DESCRIPTION OF THE PREFERRED EMBODIMENT

In response to the current inadequacies in products in the marketplace, the following disclosure is made thus showing and describing a novel improvement relative to the current state of the art. What is disclosed herein is an adapter for receiving and securing a mini-roller that is used for painting. The adapter provides a means of securely supporting the mini-roller in a spinner or high speed electric drill chuck so that it may be rotated at a high angular velocity to clean the roller.

Figure 1:
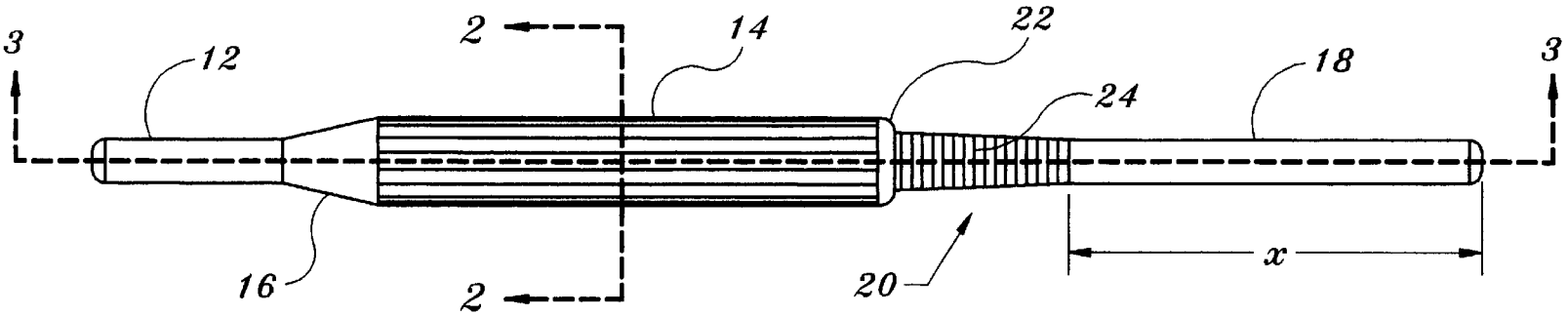
FIG. 1 is a side view of an adapter for cleaning paint rollers, the adapter produced in accordance with the preferred embodiment of the present invention.

Referring to the drawings, FIG. 1 shows one version of an adapter 10. A first rod 12 extends from one end of a handle 14. The first rod 12 is suited for being received by a drill chuck or as a guide to facilitate the device to be positioned within a paint roller spinner similar to that as shown and described in U.S. Pat. No. 2,912,769. Intermediate to the handle 14 and the first rod 12 is an annular taper 16. This taper 16 is used as a stop in positioning the end of the drill chuck and most importantly as a ramped transition to allow the jaws of a spinner to open and firmly grasp the handle 14 when the device is inserted into the spinner.

A mini-roller or weenie roller is positioned on the other end of the invention, thereby the second rod 18 receiving the internal orifice of the mini-roller. The second rod 18 is long enough that it securely supports the roller about the longitudinal centroid thereof This distance is depicted by the letter "x" and is optimally approximately 2.8 inches long. The first rod 12 is typically shorter in that its function is as a centering guide or to be received by a drill chuck.

The roller is secured onto the second rod 18 by an annular step taper 20. The step taper 20 includes a gradual taper of increasing diameter from the diameter of the rod 18 and ends at a step 22 which then concludes the transition to the handle 14. The taper is very gradual as compared to the annular taper 16, which is merely a transition ramp between the handle 14 and the first rod 12. The gradual taper of the step taper 20 is to increase the area of contact between the orifice of the mini-roller and the step taper 20. A more gradual deformation of the orifice will increase the longitudinal area of contact of the roller, thereby further stabilizing the roller onto the adapter 10. Stabilization is of utmost importance to keep the roller from becoming disengaged from the adapter and falling off when the device is placed in a spinner, or other means of providing rotational motion, and spun at a high enough speed to remove water and debris such as paint from the roller.

Though it is not a necessity, the applicants have determined that a series of annular ribs 24 placed on the step taper 20 further facilitate the retention of the mini-roller on the invention. These ribs 24 also incorporate the circular cross section of the rod 18 and step taper 20 to further conform to the shape of the orifice of the mini-roller. This increases the intimate contact area and therefore the frictional force to hold the mini-roller on the invention 10.

Figure 2:
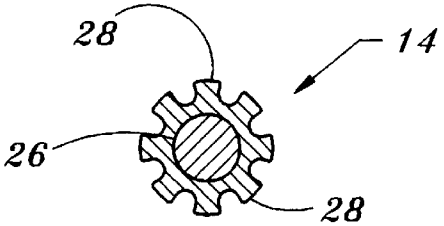
FIG. 2 is a section view along line 2—2 of an adapter for cleaning paint rollers, the adapter produced in accordance with the preferred embodiment of the present invention.

A cross sectional view of the adapter 10 as sectioned along line 2—2 is shown in FIG. 2. Here the most advantageous method of manufacturing the device is also disclosed in that the first rod 12 and the second rod 18 are made from the one structural rod 26 with the handle 14 secured thereto. The handle 14 is shown here to include a series of longitudinal ribs 28. These ribs are shown here to span the length of the handle 14 but could also functionally be confined to a region of the handle 14. The purpose of the ribs 28 are to allow the jaws of the spinner to more adequately grip the handle 14 thereby applying a torsional force to rotate the mini-roller. The ribs can also be used to facilitate gripping the invention for placement into the spinner and retrieving it from same. The orientation and design of the ribs 28 are not limited to these figures and as such it is understood that an infinite number of variations in the ribs are inherently included in this disclosure. In some cases it may be deemed advantageous to orient the ribs horizontally in this sectioned view, thus to make the device easier to produce if made through typical injection molding techniques.

Figure 3:
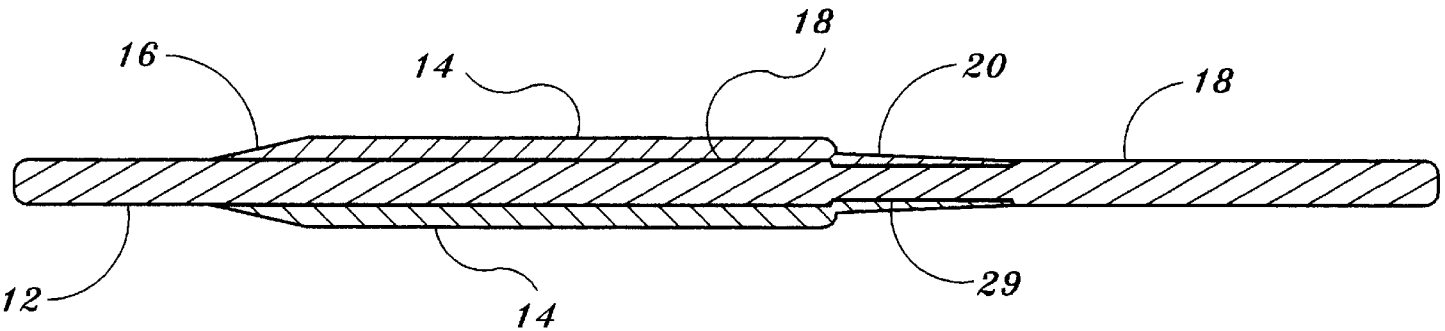
FIG. 3 is a section view along line 3—3 of an adapter for cleaning paint rollers, showing the detail of the undercut on the rod, the adapter produced in accordance with the preferred embodiment of the present invention.

A sectioned view along line 3—3 is shown in FIG. 3. Here is shown an aspect of the preferred embodiment that is not visually evident in the other views. This is the incorporation of an undercut 29 on the second rod 18 in the area under the step taper 20. This is not a necessary part of the invention in terms of the function and would obviously be utilized only when the device is made of two parts, as shown here. Here the first 12 and second rods 18 are manufactured of one piece of material and the handle 14 is secured thereto probably by way of an insert molding process. The functional necessity of the step taper 20 to be very gradual in its increase in diameter from the surface of the second rod 18 is apparent and would mean the material of the step taper 20 (probably thermoplastic) would be very thin in this area if not for the undercut 29. The undercut 29 allows this material thickness to be increased, thus decreasing the likelihood of the material failure in this area.

Figure 4:
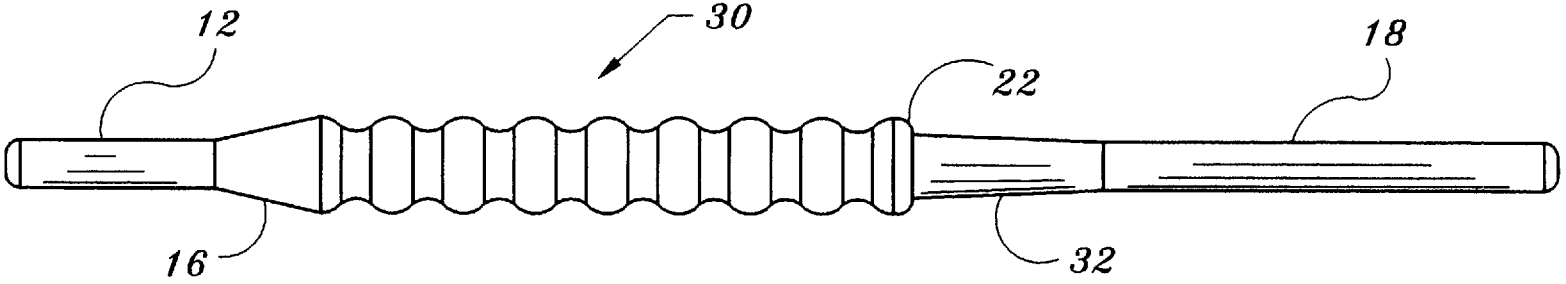
FIG. 4 is a side view of an alternative handle used on an adapter for cleaning paint rollers, the adapter produced in accordance with the preferred embodiment of the present invention.

Another version of an adapter with a ribbed handle is shown in FIG. 4, wherein the ribs are disposed annularly instead of longitudinally. In this disclosure many of the functional components of the invention are similar to that previously disclosed. The first rod 12, the second rod 18 and the annular taper 16 are all functionally equivalent to that as shown and described in FIG. 1. A corrugated handle 30 spans the distance between the annular taper 16 and the step 22. This rib orientation is useful in grasping the invention and applying force in the longitudinal direction to secure and remove the invention from the jaws of a spinner. A smooth step taper 32 is shown here as an alternative to the ribbed version previously disclosed. The general function is the same with the absence of the annular ribs. Either version would work in any combination of components of the invention as shown and described throughout this disclosure.

Figure 5:
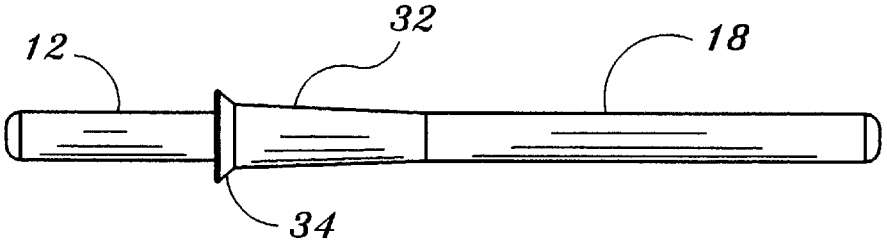
FIG. 5 is a side view of an alternative to the preferred embodiment of an adapter for cleaning paint rollers, the adapter shown without a handle.

A shortened version of the invention is shown in FIG. 5 in which the handle portion has been removed. The removal of the handle precludes use with a spinner and is directed toward use exclusively with an electric drill. In this version, the first rod 12, second rod 18 and smooth step taper 32 are again functionally equivalent to that previously disclosed. As previously mentioned the smooth step taper 32 could be substituted for the step taper 20 with ribs 24 if so desired. The ribs add a more secure fastening of the mini-roller to the smooth step taper 32 but under certain conditions concerning the manufacture of the rollers the orifice will adequately secure to the smooth step taper 32. Intermediate to the smooth step taper 32 and the first rod 12 is a modified step 34. The modified step 34 provides a boundary between the adjacent components thereby preventing contact between a mini-roller placed on the second rod 18 and a drill chuck being received by the first rod 12.

Figure 6:
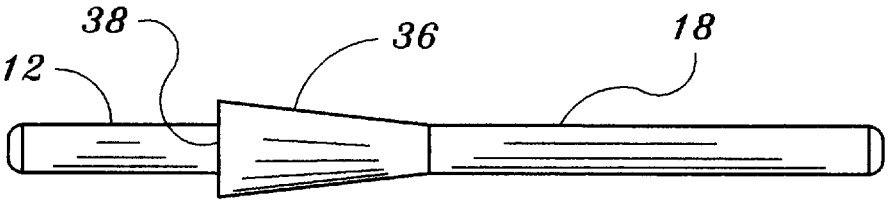
FIG. 6 is a side view of an alternative to the preferred embodiment of an adapter for cleaning paint rollers, the adapter shown with a conical tapered portion.

A slight variation to the previously disclosed is shown in FIG. 6 in which the first rod 12 and the second rod 18 remain unchanged. The smooth step taper 36 has been modified to slightly increase the angle of the taper, thereby allowing the base 38 of the conical taper to act as a step. This enables simplification of the mold or machining process yet providing only a gradual increase in diameter over the longitudinal length of the taper.

Figure 7A:
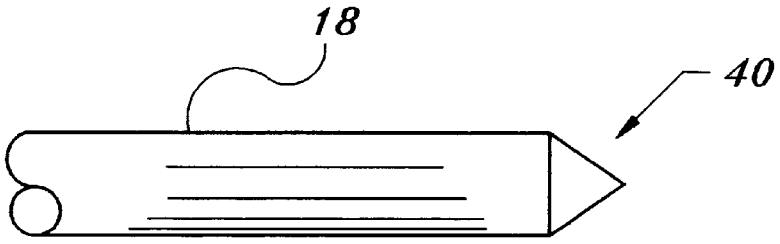
FIG. 7 are side views showing the distal portion of the rod portions of an adapter for cleaning paint rollers, the adapter produced in accordance with the preferred embodiment of the present invention.
Figure 7B:
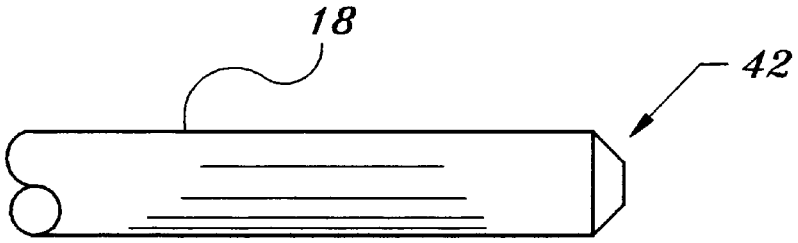
Figure 7C:
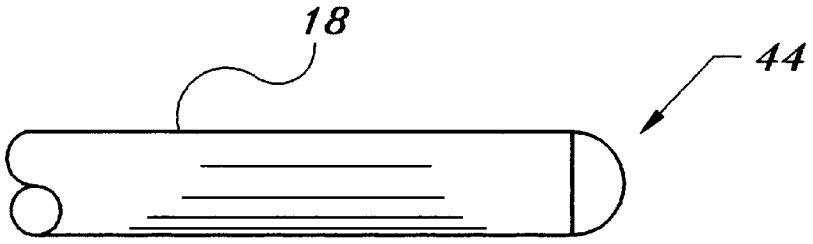

A series of useful ends of the first and second rods are shown in FIG. 7. The rods are identified as being the second rod 18 because this is the most critical in terms of the function of the end of the rods, but the same conditions can apply to the first rod as well. The three most common rod end configurations include a chamfer to a point 40 as depicted in FIG. 7*a*, a chamfer to a blunt end 42 as shown in FIG. 7*b* and a radiused end 44 as in FIG. 7*c*. Each version of the end configuration has its own benefits. In many cases penetration into the orifice of the mini-roller can be facilitated by use of a modified rod end, especially as it pertains to penetrating an indistinctly defined orifice and cavity. In some cases the mini-roller includes a supportive washer just past center of the roller. In such an situation a point would likely be most advantageous. To help prevent injury to the user, sharp edges are absent or inconsequential in the blunt or radiused versions. Any of such end configurations, or any other not directly shown, are considered inherently a part of this disclosure.

Figure 8:
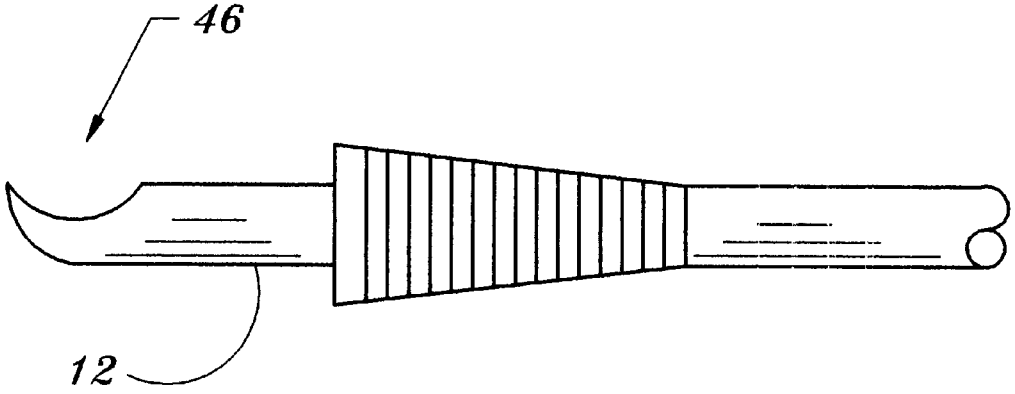
FIG. 8 is a portion of an adapter for cleaning paint rollers, the distal end of a rod portion including a paint can opener, the adapter produced in accordance with the preferred embodiment of the present invention.

Another useful option to the adapter is shown in FIG. 8 in which a hooked portion 46 is included in the end of the first rod 12. The hooked portion 46 is intended to be used as an opener to pry open cans of paint. This eliminates the need for a second tool to accomplish this task common to painting professionals. The hooked portion 46 is shown and intended to not extend beyond the boundaries of the rod 12 as previously disclosed, thereby not inhibiting the original function of the first rod 12. The hooked portion could also be used on the end of the second rod but due to the process of insertion into the mini-rollers such a configuration may become intrusive.

Figure 9:
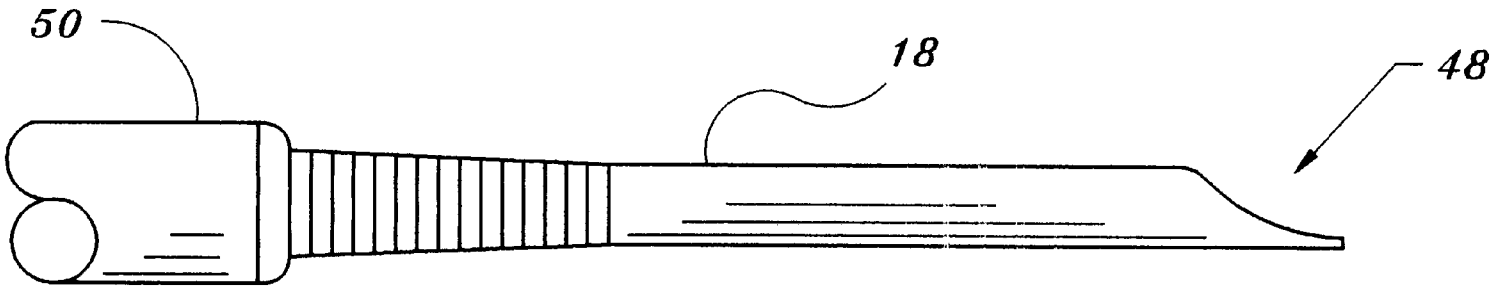
FIG. 9 is a portion of an adapter for cleaning paint rollers, the distal end of a rod portion including a taper for a paint scraper, the adapter produced in accordance with the preferred embodiment of the present invention.

A more common item that may be used on the distal end of the second rod 18 is depicted in FIG. 9, wherein an edge taper 48 is shown. An edge taper 48 can be used to scrape paint from surfaces to be painted. A paint scraper is a common tool of a painter and again this eliminates the need for a second tool. As before, this is shown on the end of the second rod 18, but it could also be used on the end of the first rod. It is preferable here because of the grater distance between the edge taper 48 and the smooth handle 50. This distance is important for "knuckle room" when pushing an object into a tight spot to remove the paint. If the tool slips, it is desirable to provide distance and therefore time for the user to move his/her hand and not scrape their knuckles on the surface. This edge taper 48 would conceivably work well as being introduced into the orifice of a mini-roller, because of the tapered profile.

The smooth handle 50 as depicted in a partial view could be used on any of the previously disclosed versions of the invention. The materials of the adapter can be varied according to the variety of uses and conditions. The preferred embodiment includes the first and second rods to be of a single piece of carbon steel or stainless steel of approximately 0.25 inches in diameter. The rest of the adapter, including the handle, step taper, step and annular taper would be a molded thermoplastic. The adapter would be made as an insert mold, the rod being the insert. The entire product could be made from thermoplastic or the device could be machined from a variety of materials including carbon steel, stainless steel, aluminum, brass, bronze or any other material common to the industry.

What is claimed is:

1. An adapter for cleaning paint rollers comprising:

a substantially longitudinal handle with a first end and a second end;

a first rod extending from said first end of said substantially longitudinal handle, the first rod being of a smaller girth than said handle;

an annular taper intermediate to the first end of said handle and said first rod, thus creating a ramped portion between same;

a second rod extending from said second end of said substantially longitudinal handle, the second rod being of a smaller girth than said handle; and an annular step taper intermediate to said second end of said handle and said second rod, thus creating a gradual increase in diameter along the taper from said second rod toward said handle, the taper at said second end of said handle being of a smaller diameter than the girth of said second end of said handle, whereby the first rod is inserted into a paint roller spinner, the annular taper providing transition of contact with the spinner from the first rod to the handle, thereby securing the handle in the spinner with the second rod extending there from, the second rod receiving a mini-roller with the step taper providing releasable attachment thereto.

2. The adapter as described in claim 1, wherein said substantially longitudinal handle is further comprised of a plurality of longitudinal ribs thereon.

3. The adapter as described in claim 1, wherein said substantially longitudinal handle is further comprised of a plurality of annular ribs thereon.

4. The adapter as described in claim 1, wherein said annular step taper is further comprised of a plurality of annular ribs to assist in releasably securing a mini-roller to the adapter.

5. The adapter as described in claim 1, wherein said first rod and said second rod have the same diameter.

6. The adapter as described in claim 1, wherein said first rod and said second rod have an end that includes a shape selected from the group consisting of a radius, a chamfer, a hook and a taper to an edge capable of being used as a scraper.

7. The adapter as described in claim 1, wherein said second rod extends from the end of said step taper a distance of approximately 2.8 inches.

8. The adapter as described in claim 1, wherein said first rod and said second rod are manufactured from material selected from the group consisting of carbon steel, stainless steel, aluminum, brass, bronze and thermoplastic.

9. The adapter as described in claim 1, wherein said substantially longitudinal handle, said annular taper and said annular step taper are manufactured from a material selected from the group consisting of carbon steel, stainless steel, aluminum and thermoplastic.

10. An adapter for cleaning paint rollers comprising:

a substantially longitudinal rod with a first end and a second end, the rod receiving the internal cavity of a mini-roller; and a conical tapered portion disposed between said first and said second ends of the rod, the conical tapered portion creating a gradual increase in diameter from the surface of the rod, the diameter increasing toward the first end of the rod, whereby the first end of said rod is secured within a chuck of a drill and the second end thereof receives a mini-roller thereon, being secured by interference with the conical tapered portion, thus allowing the mini-roller to be rotated by the drill to remove moisture and debris from the mini-roller.

11. The adapter as described in claim 10, wherein said substantially longitudinal rod is a cylindrical rod.

12. The adapter as described in claim 11, wherein said substantially longitudinal rod is a cylindrical rod with a diameter of approximately 0.25 inches.

13. The adapter as described in claim 10, wherein the side of said conical tapered portion toward the first end of the rod includes a flat portion thereon.

14. The adapter as described in claim 13, wherein said substantially longitudinal rod extends from the end of said conical tapered portion a distance of approximately 2.8 inches in the direction of said second end.

15. The adapter as described in claim 10, wherein said conical tapered portion is further comprised of a plurality of annular ribs to assist in releasably securing a mini-roller to the adapter.

16. The adapter as described in claim 10, wherein said conical tapered portion is positioned on said substantially longitudinal rod such that the tapered portion is in closer proximity to said first end of the rod than toward said second end of the rod.

17. The adapter as described in claim 10, wherein said first rod and said second rod have an end that includes a shape selected from the group consisting of a radius, a chamfer, a hook and a taper to an edge capable of being used as a scraper.

* * * * *